US007780502B2

(12) United States Patent
Calamari et al.

(10) Patent No.: US 7,780,502 B2
(45) Date of Patent: Aug. 24, 2010

(54) PARTIAL UNDERGARMENT AND METHOD FOR COVERING A WOMAN'S EXPOSED CLEAVAGE

(76) Inventors: Patricia A. Calamari, 32320 Oak Canopy Dr., Sorrento, FL (US) 32776; Karla A. Kennedy, P.O. Box 1894, New Smyrna Beach, FL (US) 32170

( * ) Notice: Subject to any disclaimer, the term of this patent is extended or adjusted under 35 U.S.C. 154(b) by 0 days.

(21) Appl. No.: 11/565,776

(22) Filed: Dec. 1, 2006

(65) Prior Publication Data

US 2007/0281585 A1 Dec. 6, 2007

Related U.S. Application Data

(60) Provisional application No. 60/809,976, filed on Jun. 1, 2006.

(51) Int. Cl.

| | |
|---|---|
| ***A41C 3/00*** | (2006.01) |
| ***A41D 1/18*** | (2006.01) |
| *A41C 3/08* | (2006.01) |
| *A41D 1/22* | (2006.01) |

(52) U.S. Cl. ..... 450/86; 450/1; 2/105; 2/106; 2/119

(58) Field of Classification Search ..... 450/1, 450/30–35, 63, 70–74, 77–80, 82, 86–88, 450/92, 93; 2/912, 913, 69, 73–75, 90, 96, 2/102–106, 109, 110, 113, 114, 118, 67, 2/119, 122, 129, 133, 46, 50–54

See application file for complete search history.

(56) References Cited

U.S. PATENT DOCUMENTS

| | | | | |
|---|---|---|---|---|
| 626,589 | A * | 6/1899 | Buchner | 450/28 |
| 731,759 | A * | 6/1903 | Dieter | 2/48 |
| 1,645,995 | A | 10/1927 | McCarthy | |
| 1,683,545 | A | 9/1928 | Harris | |
| 1,827,716 | A * | 10/1931 | Snow | 2/119 |
| 2,250,094 | A | 7/1941 | Cornibert et al | |
| 2,472,606 | A | 6/1949 | Michaelson | |
| 2,707,786 | A * | 5/1955 | Clinton | 2/119 |
| 3,064,265 | A * | 11/1962 | Bridgewaters | 2/74 |
| 5,146,626 | A * | 9/1992 | Rosado | 2/105 |
| 5,315,712 | A | 5/1994 | McTaggart | |
| 5,609,042 | A | 3/1997 | Williams | |
| 5,643,043 | A | 7/1997 | Pflum | |
| 6,205,585 | B1 * | 3/2001 | Capparelli | 2/106 |

(Continued)

OTHER PUBLICATIONS

The BRAZA CAtalogue- Camilace by BRAZA style 5000; 1994 Brazabra Corp. PO Box 698 8 Run Way Lee, MA 01238.*

*Primary Examiner*—Gloria Hale
(74) *Attorney, Agent, or Firm*—Terry M. Sanks, Esquire; Beusse Wolter Sanks Mora & Maire, P.A.

(57) ABSTRACT

A partial undergarment for covering a female's exposed cleavage area when an outer garment is worn over a bra, the partial undergarment includes a piece of material configured to extend from a first strap of the bra to a second strap of the bra, and between cups of the bra, and a plurality of fasteners respectively connected to the piece of material so that the material is attachable to the bra. The piece of material is attachable to at least two of the first strap of the bra, the second strap of the bra, and between the cups of the bra.

11 Claims, 3 Drawing Sheets

U.S. PATENT DOCUMENTS

| | | | | |
|---|---|---|---|---|
| D455,000 | S | 4/2002 | Williams | |
| 6,367,088 | B1 * | 4/2002 | Bergemann | 2/244 |
| 6,374,415 | B1 | 4/2002 | Lenart | |
| 6,390,884 | B1 | 5/2002 | Dragojevic | |
| 6,935,921 | B1 * | 8/2005 | Eudenbach et al. | 450/54 |
| D510,789 | S | 10/2005 | Byrne | |
| 2006/0025039 | A1 | 2/2006 | Barbour et al. | |

* cited by examiner

PARTIAL UNDERGARMENT AND METHOD FOR COVERING A WOMAN'S EXPOSED CLEAVAGE

CROSS-REFERENCE TO RELATED APPLICATIONS

This application claims the benefit of U.S. Provisional Application No. 60/809,976 filed Jun. 1, 2006, and incorporated herein by reference in its entirety.

FIELD OF INVENTION

The field of invention is directed towards women apparel and, more particularly, to an undergarment that may be worn to cover visible cleavage area that is exposed above a bra and left uncovered by an outer garment.

BACKGROUND OF THE INVENTION

As clothing styles change, one change that is noticeable is that for various styles of women's blouses, shirts, and/or dresses (hereinafter referred to as outer garments), the area between where a woman's breast are located is beginning to allow for more cleavage to be shown by women wearing such outer garments. Though women may like other aspects of such outer garments, some may feel uncomfortable and/or embarrassed to wear such clothing that exposes the area between where their breasts meet, commonly referred to as cleavage or cleavage area. Towards this end, women may prefer a more modest covering of their cleavage area. When such outer garments displaying an excess amount of cleavage area are worn, such women may usually wear another garment, such as a t-shirt between the outer garment and the wearer's bra. However, depending on the type of material the outer garment is made from, wear of the t-shirt may result in a bulky appearance since the woman is in essence wearing two outer garments. Furthermore, depending on the geographic location of the woman, temperatures may be too hot to allow for a comfortable wearing of two outer garments. Women would benefit from a garment that allows for covering exposed cleavage area while not resulting in a bulky appearance and/or being uncomfortable to wear in hot weather conditions.

Typically, because of breast cancer, women may also face the undesired choice of having to undergo a mastectomy, or double mastectomy. As discussed above, these women may also like certain blouses, shirts, and/or dresses, but are uncomfortable wearing such garments because of the appearance of the cleavage area after either a single mastectomy or double mastectomy. Women undergoing other surgical procedures may also desire to have cleavage area further covered due to scarring. Thus women having undergone surgical procedures would also benefit from a garment that allows for covering cleavage area that may not be as flattering after such medical procedures.

BRIEF DESCRIPTION OF THE INVENTION

Embodiments of the invention are directed towards women apparel. A partial undergarment for covering a female's exposed cleavage when an outer garment is worn over a bra is disclosed. The partial undergarment includes a piece of material configured to extend from a first strap of the bra to a second strap of the bra, and between cups of the bra, and a plurality of fasteners respectively connected to the piece of material so that the material is attachable to the bra. The piece of material is attachable to at least two of the first strap of the bra, the second strap of the bra, and between the cups of the bra.

In another exemplary embodiment a partial undergarment for covering a female's cleavage exposed when a bra and outer garment are worn is disclosed. The partial undergarment includes a nearly triangular shaped piece of material with a first vortex that reaches to a first strap of the bra, a second vortex that reaches to a second strap of the bra, and a third vortex that reaches between cups of the bra, and fasteners connected to each of the first vortex, second vortex, and third vortex. The nearly triangular shaped piece of material is attachable to the bra by securing, with the fasteners, to at least two of the first vortex to the first bra strap, the second vortex to the second bra strap, and the third vortex between cups of the bra.

In yet another exemplary embodiment, a method for covering a woman's cleavage exposed when a bra and outer garment are worn is disclosed. The method includes a step of determining a distance between a first bra strap and a second bra strap when the bra is worn by the woman. Another step includes determining a distance between a top of a cup of the bra and a bottom of the cup of the bra. A determination is made for a size of a piece of material having a plurality of fasteners that extends between the first bra strap, the second bra strap and between the cups of the bra based on the distance between the first bra strap and the second bra strap, and the distance between the top of the cup of the bra and the bottom of the cup of the bra. Another step includes securing the piece of material to the bra with the fasteners by attaching the piece of material to at least two of the first bra strap, the second bra strap, and between the cups of the bra.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
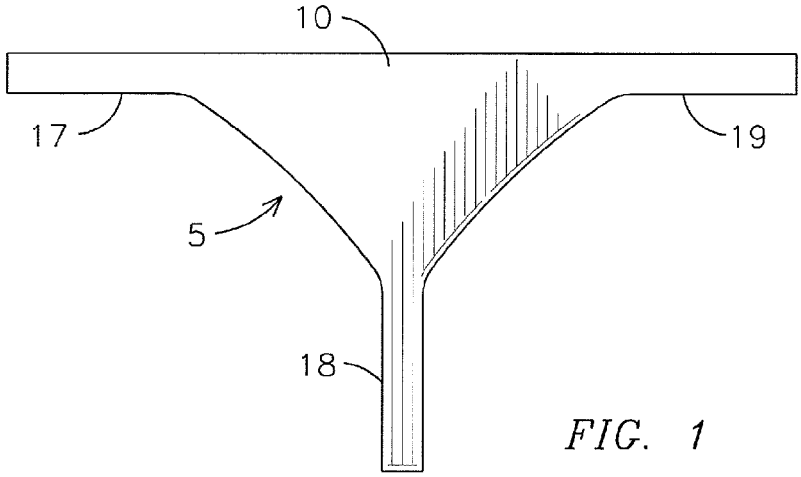
FIG. 1 discloses an exemplary embodiment of a front side of a partial undergarment.

FIG. 1 discloses an exemplary embodiment of a front side of the partial undergarment. As illustrated, the partial undergarment 5 is nearly triangular in shape. Though a nearly triangular shape is illustrated, those skilled in the art will readily recognize that other shapes may be used as well. For example, if the part of the partial undergarment 5 that is visible from the outer garment is to have another shape, such as, but not limited to, a rounded or arcuate shape may be used for the top part 10 of the partial undergarment 5 that is visible. Thus, even though one exemplary embodiment of the shape of the partial undergarment 10 is nearly triangular, the partial undergarment 10 may have other shapes, such as, but not limited to, being circular, rectangular, square, an undefined configuration, in shape, wherein the visible part of the partial undergarment, the part that is visible when a woman is clothed, is formed to provide a certain shape.

Figure 2:
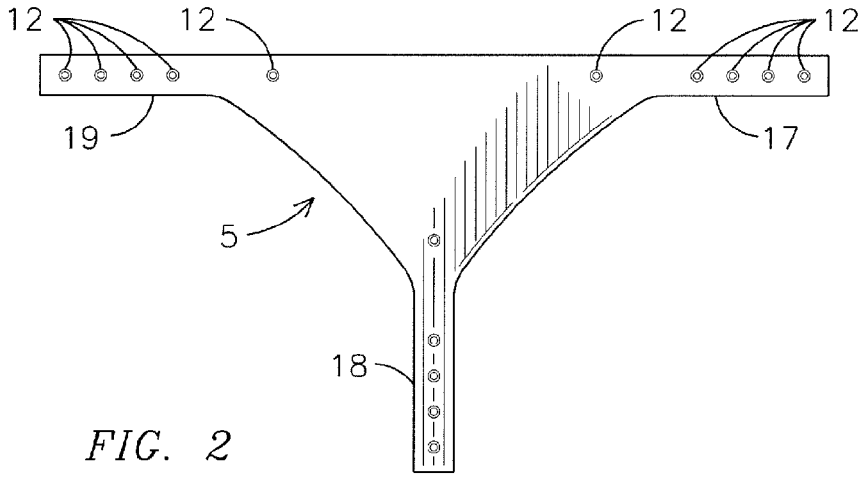
FIG. 2 discloses an exemplary embodiment of a backside of the partial undergarment wherein fasteners are disclosed.
Figure 3A:
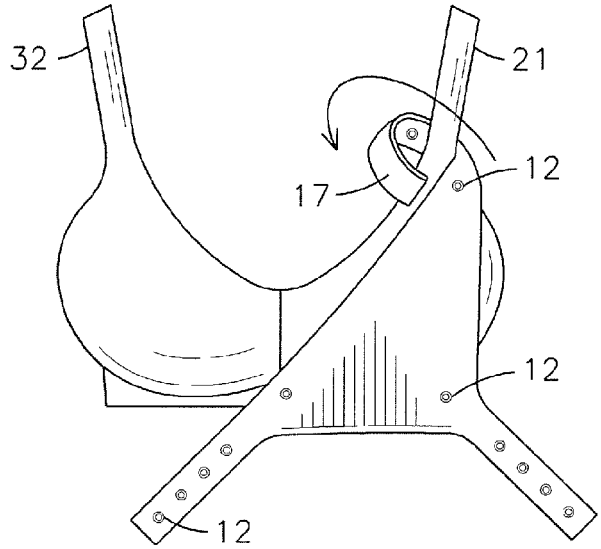
FIGS. 3A-3C disclose exemplary embodiments of how the partial undergarment is attached.
Figure 3B:
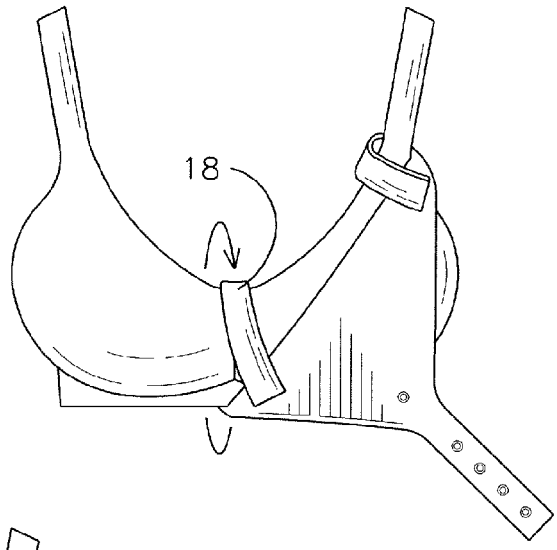
Figure 3C:
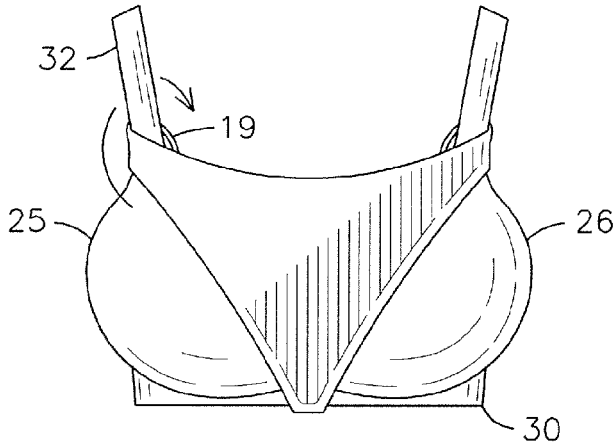

FIG. 2 discloses an exemplary embodiment of a backside of the partial undergarment wherein fasteners are disclosed. As illustrated, fasteners 12 are provided at each vortex 17, 18, 19, or point, on the triangular material of the partial undergarment 5. Though three fastener areas 17, 18, 19 are disclosed, one at each vortex 17, 18, 19, fewer or more fasteners and or fastener areas may also be used. For example if fewer fastener areas, vortexes, 17, 19 are used, fasteners 12 are only provided to secure the partial undergarment 5 above each bra cup 25, 26 (the bra 30 and bra cups 25, 26 are illustrated in FIGS. 3A-3C. The types of fasteners 12 may be of a plurality of types. For example, but not limited to, they can be snaps, buttons, or looped material, etc. In another exemplary embodiment the fasteners 12 may be of a type that allows these elements to fit within a receiving part of the bra 30, where the receiving part is permanently fixed on or through the bra 30. Thus when various shaped partial undergarments 5 are provided as disclosed above, these various shaped partial undergarments 5 have vortexes 17, 18, 19 where fasteners 12 are provided to secure the partial undergarment 5 to the bra 30. The vortexes 17, 18, 19 may be formed within the shaped partial undergarment, such as if the partial undergarment 5 is circular the vortexes 17, 18, 19 do not extend from the partial undergarment but the partial undergarment retains its circular shape. In another exemplary embodiment, regardless of the shape of the partial undergarment 5, the vortexes 17, 18, 19 extend from the partial undergarment 5, as illustrated in FIGS. 1 and 2.

FIGS. 3A-3D disclose exemplary embodiments of how the partial undergarment is worn. In an exemplary embodiment, three vortexes 17, 18, 19 are provided and snaps 12 are used to secure the partial undergarment 5, as disclosed above. A first vortex 17 is wrapped under a bra strap 21 and is then snapped into place. The second vortex 18 is wrapped around the part of the bra 30 between the cups 25, 26 of the bra 30, and is snapped into place. The third vortex 19 is wrapped under the second bra strap 32 and is then snapped into place.

Figure 4:
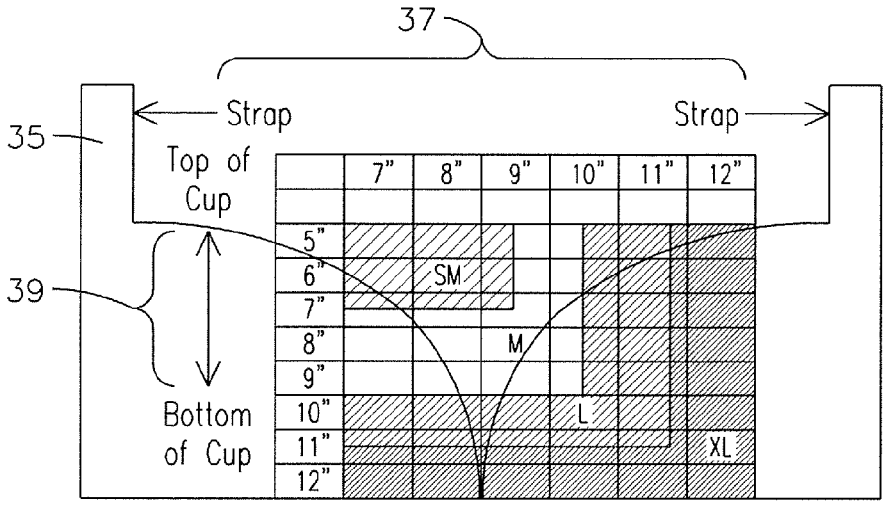
FIG. 4 discloses an exemplary embodiment of a sizing chart to ensure a woman selects the correct partial undergarment based on her bra dimensions when the bra is worn.

FIG. 4 discloses an exemplary embodiment of a sizing guide 35 illustrating how sizing for the modest panel is done. Even though bras 30 are provided by bra cup size, women's shapes vary by more than just bra cup size. For example, once a woman has a bra 30 on, the distance between the bra straps 21, 32 may vary from one woman to another woman. Similarly, depending on the height of the bra cup 25, 26, sizing is also different. As illustrated, taking into account the distance between bra straps 37 and distance from the top of the bra cup to the bottom of the bra cup 39, the partial undergarment 5 may be configured to best fit women.

Figure 5A:
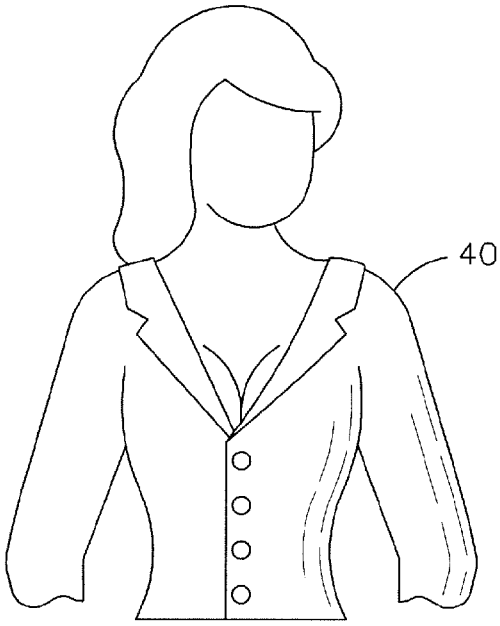
FIGS. 5A-5D disclose exemplary embodiments of the partial undergarment when worn with various ornamental designs, and when the partial undergarment is not worn.
Figure 5B:
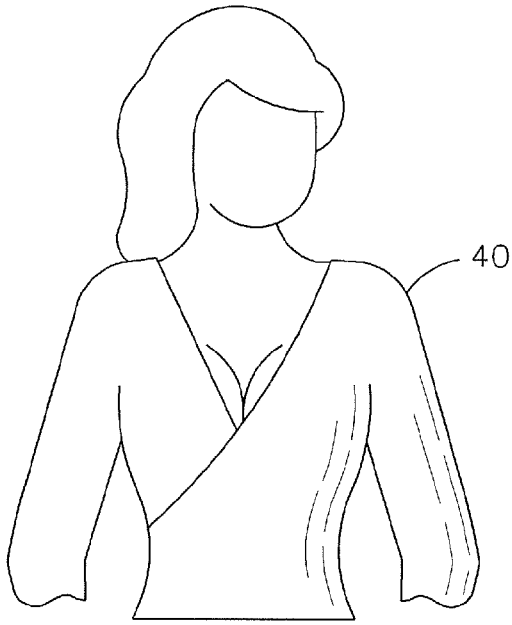

FIGS. 5A-5D disclose exemplary embodiments of the partial undergarment when worn and when not worn. As illustrated in FIGS. 5A & 5B, because of a design of an outer garment 40, such as, but not limited to, a blouse, dress, or shirt, when the partial undergarment 5 is not worn it is possible that more cleavage is shown than the woman may want visible. As then illustrated in FIGS. 5C & 5D, the cleavage areas exposed in FIGS. 5A & 5B are further covered since the partial under garment 5 is visible where cleavage once was visible.

Figure 5C:
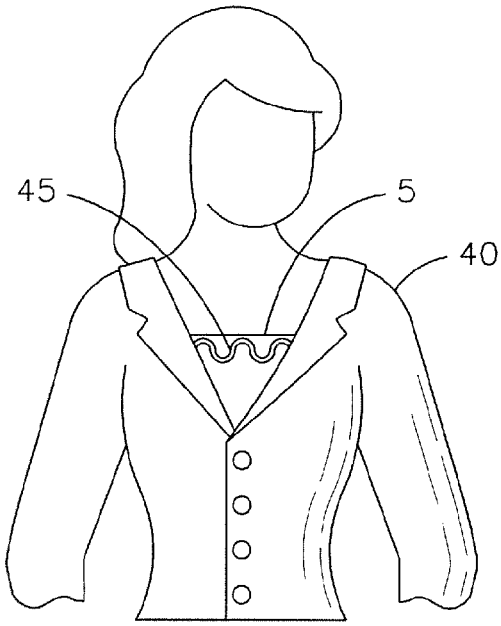
Figure 5D:
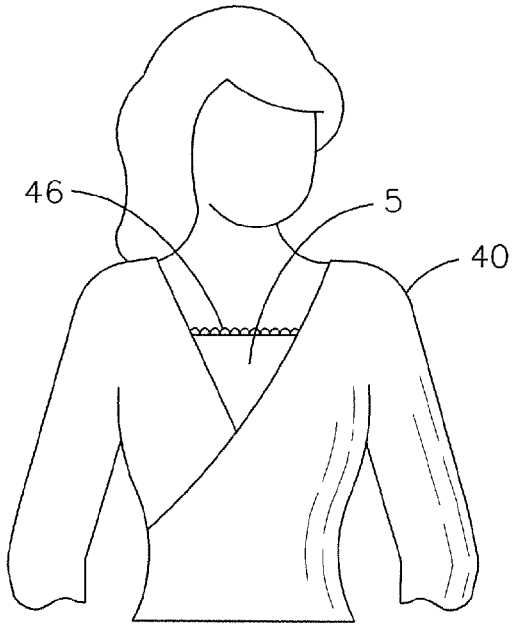

Additionally, ornaments, such as, but not limited to, ruffles along the edge of the partial under garment and an emblem on the visible top part 10 of the partial undergarment 5, may be included. The partial undergarment 5 in FIG. 5C illustrates a partial undergarment with an emblem 45. The partial undergarment 5 in FIG. 5D illustrates a partial undergarment 5 with a frilly edge 46 along the edge that is visible when the partial undergarment 5 is worn.

Because the partial undergarment 5 is independent of the bra 30 and outer garment 40, it may be worn with a plurality of bras 30 and outer garments 40. The color of the partial undergarment may vary as well. Additionally the partial undergarment may be made from various fabrics.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. does not denote any order or importance, but rather the terms first, second, etc. are used to distinguish one element from another.

What we claim is:

1. A partial undergarment for covering a female's exposed cleavage area when an outer garment is worn over a bra, the bra comprising a pair of cups, a first shoulder strap, a second shoulder strap, and a band interconnecting the pair of cups, the partial undergarment comprising:

a piece of material comprising a first vortex configured to extend to and around the first shoulder strap of the bra at a location immediately above a first cup, a second vortex configured to extend to and around the second shoulder strap of the bra at a location immediately above a second cup, and a third vortex configured to extend to and around the band interconnecting the pair of cups of the bra, each vortex being a single piece of material extending from a main part of the piece of material; and a plurality of fasteners respectively connected to the piece of material, the plurality of fasteners comprises first components and second components which mate to each other to secure the material to the bra;

wherein at least the first component of a first one of the plurality of fasteners is attached to the first vortex, at least the first component of a second one of the plurality of fasteners is attached to the second vortex, at least the first component of a third one of the plurality of fasteners is attached to the third vortex, and each second component is attached to the piece of material.

2. The partial undergarment according to claim 1 wherein the piece of material further comprises at least one of a design on an exterior portion of the piece of material exteriorly visible when the outer garment is worn and a design on an edge of the piece of material exteriorly visible when the outer garment is worn.

3. The partial undergarment according to claim 1 wherein the plurality of fasteners comprise at least one of snaps, buttons, or a hook and loop component.

4. The partial undergarment according to claim 2 wherein the at least one of a design on an exterior portion of the piece of material exteriorly visible when the outer garment is worn and a design on an edge of the piece of material exteriorly visible when the outer garment is worn retains a same spatial location with respect to the bra each time the partial undergarment is secured to the bra.

5. A partial undergarment for covering a female's cleavage area exposed when a bra and outer garment are worn, the bra comprising a pair of cups, a first shoulder strap, a second shoulder strap, and a band interconnecting the pair of cups, the partial undergarment comprising:

a nearly triangular shaped piece of material with a first vortex that is configured to reach to the first shoulder strap of the bra, a second vortex that is configured to reach to the second shoulder strap of the bra, and a third central vortex that is configured to reach the band interconnecting the pair of cups of the bra, wherein each of the first vortex, the second vortex, and the third central vortex comprises a single piece of material extending therefrom a main body of the triangular shaped piece of material; and a plurality of first fastener on at least each of the first vortex, the second vortex, and the third central vortex and a plurality of second fasteners on the main body of the nearly triangular shaped piece of material;

(c) wherein the first fastener of each of the single vortexes is configured to mate with a corresponding one of the plurality of second fasteners on the main body of the nearly triangular shaped piece of material to secure the nearly triangular piece of material to the bra upon looping of each of the vortexes around a corresponding one of the first shoulder strap of the bra at a location immediately above a first bra cup, the second shoulder strap of the bra at a location immediately above a second bra cup, and the band interconnecting the pair of cups of the bra.

6. The partial undergarment according to claim 5 wherein the nearly triangular shaped piece of material further comprises at least one of a design on an exterior portion of the piece of material exteriorly visible when the outer garment is worn and a design on an edge of the material exteriorly visible when the outer garment is worn.

7. The partial undergarment according to claim 5 wherein the plurality of fasteners comprise at least one of snaps, buttons, or a hook and loop component.

8. The partial undergarment according to claim 6 wherein the at least one of a design on an exterior portion of the piece of material exteriorly visible when the outer garment is worn and a design on an edge of the material exteriorly visible when the outer garment is worn retains a same spatial location with respect to the bra each time the partial undergarment is secured to the bra.

9. A method for covering a woman's cleavage area exposed when a bra and an outer garment are worn:

determining a distance between a first shoulder strap and a second shoulder strap when the bra is worn by the woman, the bra comprising a pair of cups, the first shoulder strap, the second shoulder strap, and a band interconnecting the pair of cups;

determining a distance between a top and a bottom of at least one cup of the pair of cups of the bra with a measuring device;

providing an amount of material;

constructing a piece of material from said amount of material, wherein the piece of material has a plurality of vortexes, and wherein each of the plurality of vortexes comprises a single piece of material that extends therefrom a main body of the piece of material;

providing a first fastener on each of the vortexes and a plurality of second fasteners on the main body of the piece of material; and securing the piece of material to the bra with the plurality of fasteners by mating the first fastener on each of the vortexes with a corresponding one of the plurality of second fasteners on the main body of the piece of material upon looping of the respective vortex around a corresponding one of the first shoulder strap of the bra at a location immediately above a first bra cup, the second shoulder strap of the bra at a location immediately above a second bra cup, and the band interconnecting the pair of cups of the bra.

10. The method of claim 9 further comprises displaying a design on at least one of an exterior portion of the piece of material exteriorly visible when the outer garment is worn and an edge of the piece of material that is exteriorly visible when the outer garment is worn.

11. The method of claim 9 wherein the fasteners comprise at least one of snaps, buttons, or a hook and loop component.

* * * * *